US007497264B2

(12) United States Patent
Moody et al.

(10) Patent No.: US 7,497,264 B2
(45) Date of Patent: Mar. 3, 2009

(54) MULTILATERAL PRODUCTION APPARATUS AND METHOD

(75) Inventors: Braxton I. Moody, Tomball, TX (US); Douglas James Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 63 days.

(21) Appl. No.: 11/335,413

(22) Filed: Jan. 19, 2006

(65) Prior Publication Data

US 2006/0201677 A1 Sep. 14, 2006

Related U.S. Application Data

(60) Provisional application No. 60/647,207, filed on Jan. 26, 2005.

(51) Int. Cl.
*E21B 17/18* (2006.01)

(52) U.S. Cl. ..... 166/313; 166/242.3

(58) Field of Classification Search ..... 166/313, 166/50, 117.5, 117, 242.6, 242.3
See application file for complete search history.

(56) References Cited

U.S. PATENT DOCUMENTS 2,242,378 A * 5/1941 Vollbach et al. ..... 454/338
4,489,782 A * 12/1984 Perkins ..... 166/248
5,439,051 A * 8/1995 Kennedy et al. ..... 166/50
5,472,048 A * 12/1995 Kennedy et al. ..... 166/50
6,015,012 A 1/2000 Reddick
6,315,054 B1 11/2001 Brunet
6,349,769 B1 2/2002 Ohmer
6,354,375 B1 * 3/2002 Dewey ..... 166/313
6,390,198 B2 * 5/2002 Brooks et al. ..... 166/313
6,561,277 B2 * 5/2003 Algeroy et al. ..... 166/373
6,561,279 B2 5/2003 MacKenzie et al.
6,568,469 B2 * 5/2003 Ohmer et al. ..... 166/50
6,729,410 B2 5/2004 Steele
6,732,802 B2 5/2004 Smith
6,789,628 B2 9/2004 Hess et al.
6,802,371 B2 * 10/2004 Collins et al. ..... 166/50
6,840,321 B2 1/2005 Restarick et al.
6,863,129 B2 * 3/2005 Ohmer et al. ..... 166/313
6,915,847 B2 * 7/2005 Brockman ..... 166/250.08
7,100,693 B2 * 9/2006 Collins et al. ..... 166/308.1
7,104,324 B2 * 9/2006 Wetzel et al. ..... 166/278
7,104,332 B2 9/2006 Murray et al.
7,207,383 B2 * 4/2007 Hurst et al. ..... 166/242.3
7,231,980 B2 6/2007 Murray et al.
7,273,109 B2 9/2007 Moore et al.

(Continued)

OTHER PUBLICATIONS

Hill, Jr., et al. "The Integration of Intelligent Well System into Sand Control Completions for Selective Reservoir Flow Control in Brazil's Deepwater," The Society of Petroleum Engineers, SPE 78271. Aberdeen, Scotland, U.K. Oct. 29-31, 2002.

(Continued)

*Primary Examiner*—David J Bagnell
*Assistant Examiner*—Daniel P Stephenson
(74) *Attorney, Agent, or Firm*—Cantor Colburn LLP

(57) ABSTRACT

A wellbore junction. The junction includes a discrete primary leg and a discrete lateral leg connected to the primary leg, at least one of the legs comprising a plurality of non-nested flow passageways.

20 Claims, 7 Drawing Sheets

U.S. PATENT DOCUMENTS

| | | | | |
|---|---|---|---|---|
| 2005/0039915 | A1* | 2/2005 | Murray | 166/255.1 |
| 2005/0061511 | A1* | 3/2005 | Steele | 166/313 |
| 2006/0000614 | A1 | 1/2006 | Restarick et al. | |
| 2006/0180316 | A1* | 8/2006 | Steele et al. | 166/381 |

OTHER PUBLICATIONS

Hay, et al. "Using TAML-3 Multilateral Technology to Deliver a Technologically Challenging, Fast-Track, One-Well Development in the Southern North Sea." Society of Petroleum Engineers, SPE 84028. Denver, Colorado, U.S. Oct. 5-8, 2003.

Rump, et al. "Multilateral/Intelligent Wells Improve Development of Heavy Oil Field—A Case History." Society of Petroleum Engineers, IADC/SPE 87207. Dallas, Texas, U.S. Mar. 2-4, 2004.

Pasicznyk, Adam. "Evolution Toward Simpler, Less Risky Multilateral Wells," Society of Petroleum Engineers, SPE/IADS 67825, Amsterdam, The Netherlands, Feb. 27-Mar. 1, 2001.

Fraija, J., et al. "New Aspects of Multilateral Well Construction." Oilfield Review vol. 14, No. 3, Autumn 2002: 18 pages. Retrieved online on Jun. 27, 2008 from: http://www.slb.com/media/services/resources/oilfieldreview/ors02/aut02/p52_69.pdf.

"Appendix E: Directional and Extended-Reach Drilling," Final Finding of the Director, Oil and Gas Lease Sale, Beaufort Sea Areawide 1999: Jul. 15, 1999: 7 pages. Alaska Department of Natural Resources, Division of Oil & Gas. Retrieved online on Jun. 27, 2008 from: http://www.dog.dnr.state.ak.us/oil/products/publications/beaufortsea/bsa1999_final_finding/appe.pdf.

Diggins, E. "Multi Lateral Well Classification Matrix," Wirtten on fehalf of the participants of the forum on Technical Advancement-Multilaterals (TAML) Date unknown: 6 pages. Retrieved online on Jun. 27, 2008 from: http://www.taml.net/docs/MULTI%20LATERAL%20WELL%20CLASSIFICATION%20MATRIX%20-%20Eric%20Diggins.doc.pdf.

* cited by examiner

MULTILATERAL PRODUCTION APPARATUS AND METHOD

CROSS REFERENCE TO RELATED APPLICATIONS

This application claims the benefit of an earlier filing date from U.S. Provisional Application Ser. No.: 60/647,207 filed Jan. 26, 2005, the entire disclosure of which is incorporated herein by reference.

BACKGROUND

The hydrocarbon exploration and recovery industry is forced with growing demand worldwide and therefore faced with the ever-increasing need for greater efficiency in completing boreholes for production both from cost and rapidity standpoints. In an effort to continue to raise the bar that represents these interests, inventors are constantly seeking out new ways to improve the process. While many improvements have been made and successfully implemented over the years, further improved procedures, configurations, etc. are still needed. In the downhole environment directly, multilateral wellbore construction and completion has become increasingly ubiquitous in recent years. Multilateral wellbores allow for a greater return on investment associated with drilling and completing a wellbore simply because more discrete areas/volumes of a subterranean hydrocarbon deposit (or deposits) is/are reachable through a single well. Moreover, such multilateral wellbore systems have a smaller footprint at the earths surface, reducing environmental concerns. Multilateral wellbores generally require "junctions" at intersection points where lateral boreholes meet a primary borehole or where lateral boreholes (acting then as sub primary boreholes) meet other lateral boreholes. "Junctions" as is familiar to one of skill in the art are "Y" type constructions utilized to create sealed flow paths at borehole intersections and are generally referred to as having a "primary leg" and a "lateral leg".

There is a need in the industry for the flow of fluids at a multilateral intersection to be isolated from the formation. This is commonly known as a sealed junction. There are currently a number of ways of achieving this. For a given main well bore size two tubing strings can be run, one to the main bore and one to the lateral. If larger tubing strings are required then either a larger main bore is required or at least one of the tubing strings must be shaped prior to installation. An alternate to these is to construct the sealed junction downhole at the intersection of the main bore and lateral. Each of these methods has advantages and disadvantages. By utilizing two small tubes the junction can withstand high pressure differentials, but forgoes flow area and hence production rate. A large main bore and large tubing strings gains flow area and rate with moderate to high pressure ratings, but the increased sizes can have a major financial impact on numerous other related equipment in the overall well system. Junction systems where the tubing strings are not round end up with increases in flow area and rate over the small tubing strings, but are inherently lower in pressure and load rating. Systems where the sealing mechanism is assembled down hole have so far been complex to manufacture and install, with minimal increase in flow area, and with pressure ratings approximately equal to the non-round versions.

Since ease of installation, sealing and high overall strength characteristics are always a high priority, improved junction systems are always well received by the relevant art.

SUMMARY

Disclosed herein is a wellbore junction. The junction includes a discrete primary leg and a discrete lateral leg connected to the primary leg, at least one of the legs comprising a plurality of flow passageways.

Further enclosed herein is a wellbore system. The system includes a junction having a discrete primary leg and a discrete lateral leg connected to the primary leg, at least one of the legs comprising a plurality of flow passageways, the junction disposed at an intersection between a primary borehole and a lateral borehole.

Yet further disclosed herein is a method for installing a junction in a wellbore. The method includes running a junction having a discrete primary leg and a discrete lateral leg connected to the primary leg at least one of the legs comprising a plurality of flow passageways. The method further includes landing the junction at an intersection between a primary borehole and a lateral borehole and causing the lateral leg to enter the lateral borehole and causing the lateral leg to enter the lateral borehole.

BRIEF DESCRIPTION OF THE DRAWINGS

Referring now to the drawings wherein like elements are numbered alike in the several Figures.

DETAILED DESCRIPTION

Figure 1:
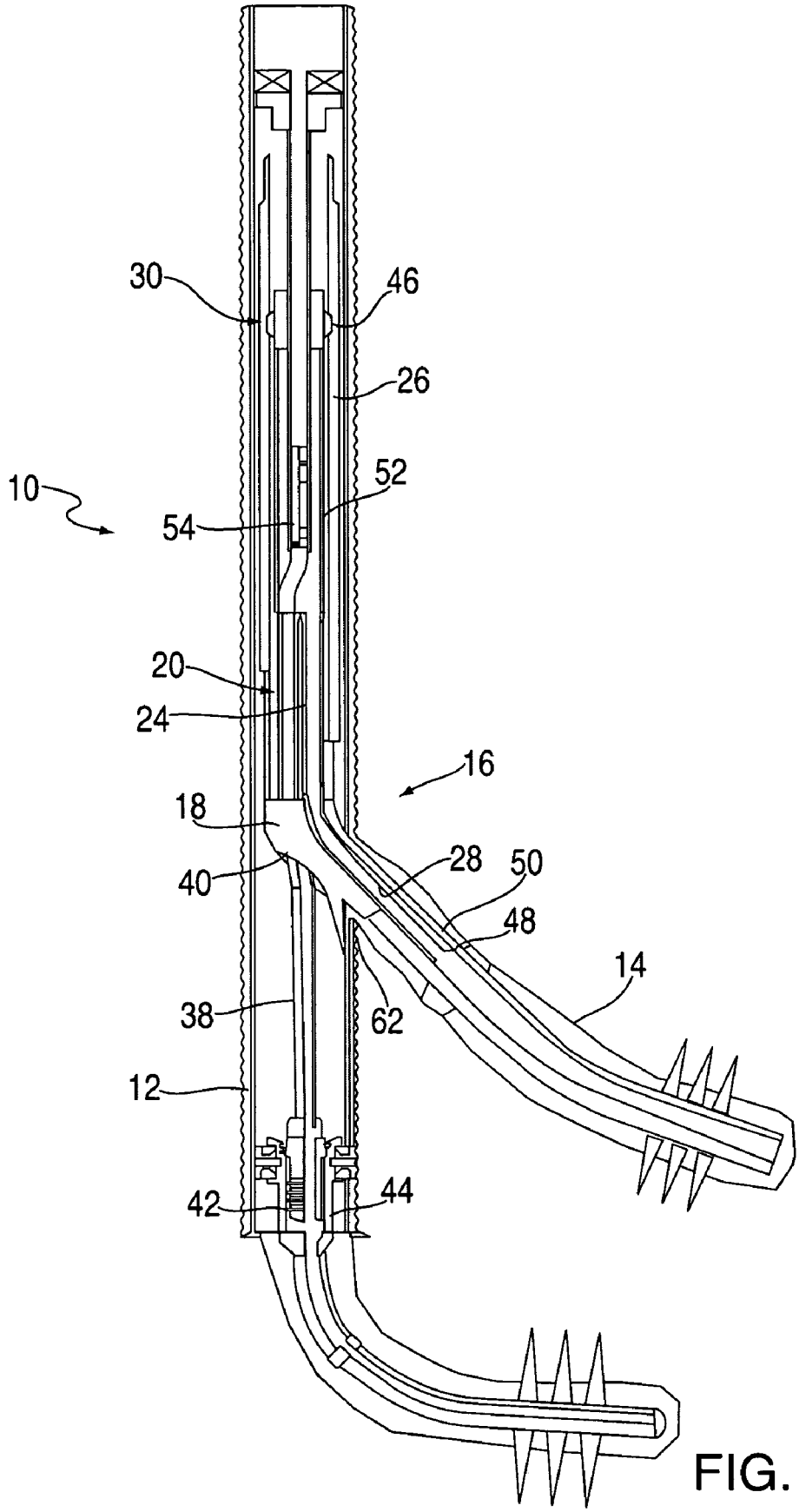
FIG. 1 is a schematic representation of a wellbore intersection having a junction assembly illustrated therein.

FIG. 1 is a schematic view of a first embodiment of a wellbore junction and ancillary components utilized therewith or forming a portion thereof. A wellbore 10 is generally illustrated having a primary borehole 12 and a lateral borehole 14. It will be appreciated that additional laterals may exist in an actual wellbore and that this drawing merely illustrates a small portion of the overall wellbore system.

At an intersection 16 between primary borehole 12 and lateral borehole 14, there is illustrated a hook hanger liner hanger 18. This system is commercially available from Baker Oil Tools, Houston, Texas. As such, the hanger 18 does not require a detailed description of its structure and operation. At an uphole end of hanger 18 is an orientation profile 20 configured to provide a clear indication as to an angular location of the lateral borehole 14. The hanger 18 is installed in the wellbore prior to running the junction, in accordance with well-established procedures.

Figure 2:
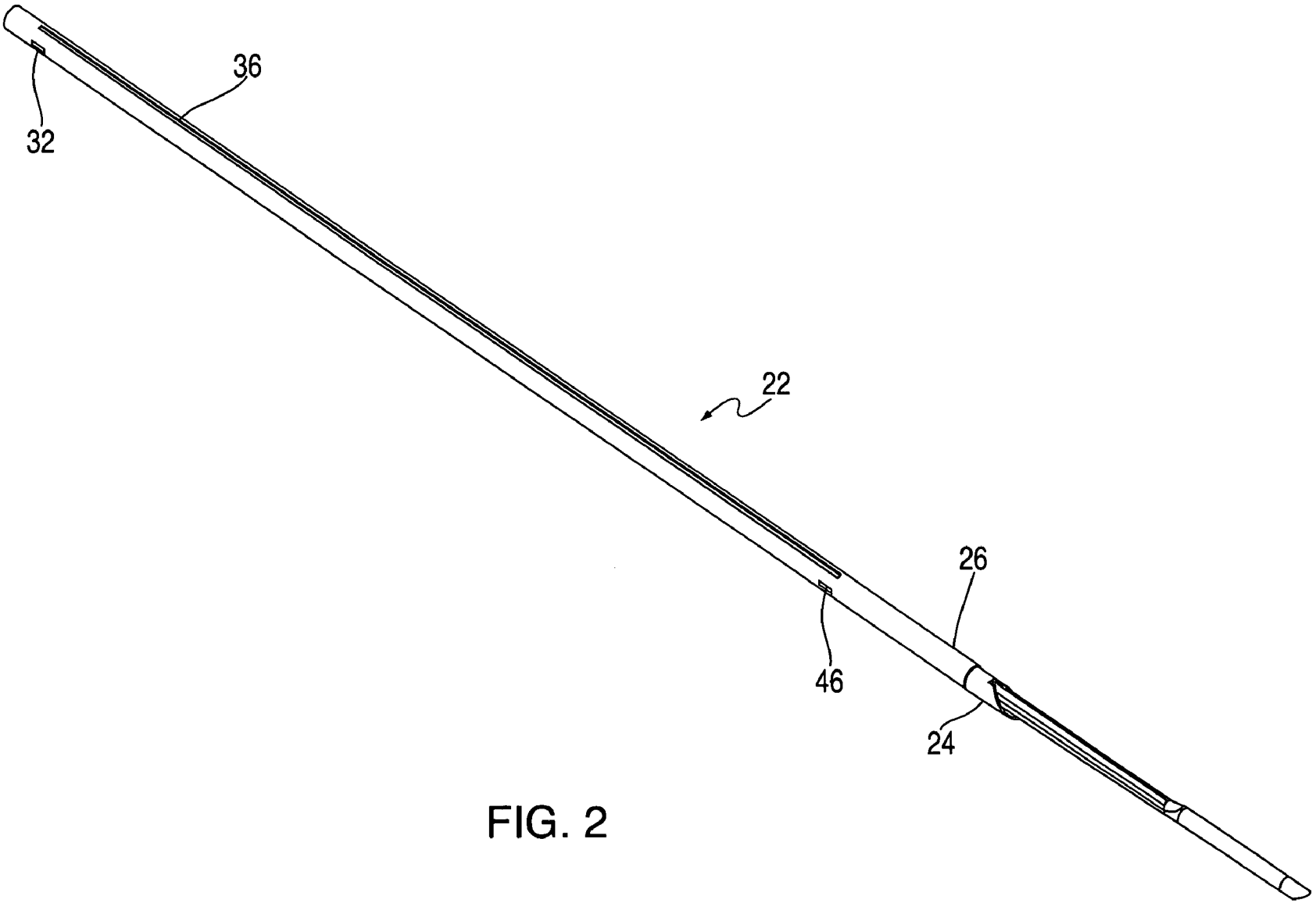
FIG. 2 is a schematic view of a junction and sleeve assembly in a run-in position.
Figure 3:
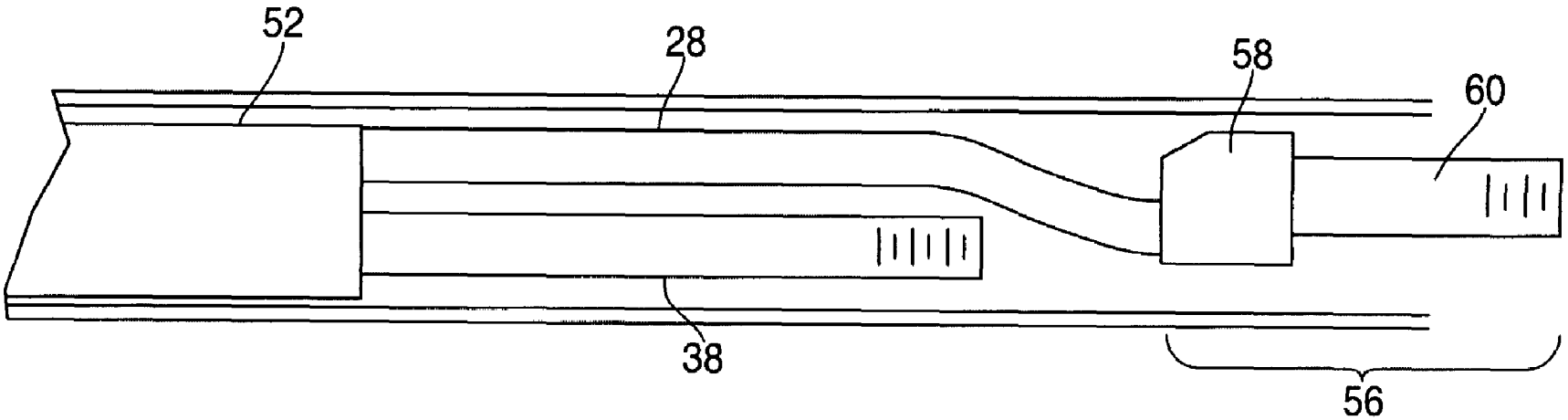
FIG. 3 is a schematic sectional view of a junction as disclosed in a casing segment.

In a subsequent run in the wellbore 10, junction and sleeve assembly 22 (which comprises an external orientation sleeve 26 and a junction 34, both more formally introduced hereunder) (see FIG. 2) is run in the hole to mate with orientation profile 20 on hanger 18. It is to be noted that numeral 22 does not appear on FIG. 1 because it would require a bracket large enough to render the designation meaningless. A complete understanding of the component and its relative position will be gained by a consideration of other numerals appearing in both FIGS. 1 and 2. Referring to FIGS. 1 and 2 simultaneously, an orientation profile 24 on an external orientation sleeve 26 is visible. It is this profile 24 that lands on profile 20 to orient the junction and sleeve assembly 22, thereby ensuring that a lateral leg 28 of the junction 34 enters the lateral borehole 14 as appropriate. Orientation is particularly important in this embodiment as there is no diverter sub to direct the lateral leg 28 out of the primary borehole and into the lateral borehole 14. Rather, in this embodiment, an offset sub 56 is used to encourage entry of the lateral leg 28 into the lateral borehole 14. Referring to FIG. 3, the offset sub 56 includes a manifold 58 and a seal sub 60. Manifold 58 is essentially a box having an inlet configured to receive the plurality of passageways of lateral leg 28 and join a flow volume therefrom to the seal sub 60. Moreover, the manifold 58 offsets seal sub 60 as illustrated. The offset places an outside radial position of the manifold and seal sub at a radial distance from an axial center of body 52 that is greater than body 52 itself has. Moreover, the same dimension causes a perimetric dimension of the junction 34 to be larger overall than the diameter of a casing string through which it is run. Since the tool is urged into the casing anyway, the configuration of manifold 58 causes the lateral leg 28 to resiliently deflect toward the primary leg 38. The lateral leg in such condition is energized to spring radially outwardly away from the primary leg 38 and the lateral leg 28 will do so when an opportunity is provided. This will occur when the offset sub reaches a window of the lateral borehole intersection. Because the seal sub is also offset from the axis of lateral leg 28, the movement of offset sub 56 is sufficient to place seal sub 60 into lateral 14 and, laterally beyond a downhole intersection point 62 (see FIG. 1) of intersection 16. This will cause the lateral leg 28 to automatically enter the lateral. A traditional "bent joint" concept could also be employed in some embodiments.

Figure 4:
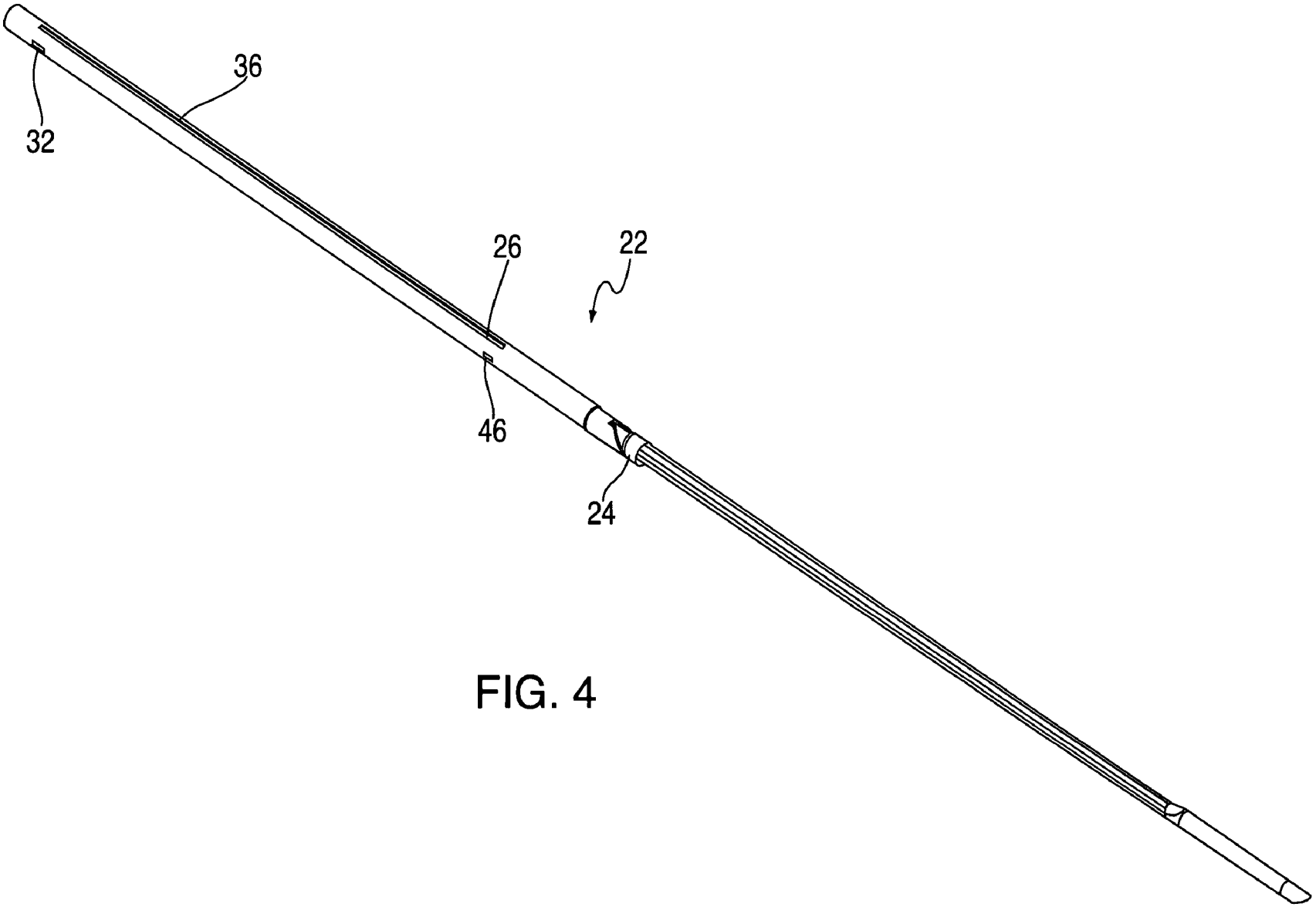
FIG. 4 is a schematic view of a junction and sleeve assembly in a landed position.

Once the external orientation sleeve 26 is seated at hanger 18, sleeve 26 no longer moves downhole. Further, weight from uphole on the assembly causes a collet 30 to disengage from the initial collet profile 32, (see FIG. 2) in sleeve 26 thereby allowing a junction 34 (see FIG. 5) to stroke downhole inside of sleeve 26 and through hanger 18. For clarity of understanding, the junction and sleeve assembly 22 is illustrated in the stroked position apart from other components in FIG. 4. Referring back to FIG. 2, an alignment slot 36 is provided in sleeve 26 to assist in ensuring that the junction 34 remains orientated during the stroking process. In one embodiment the stroke is about 15 feet long.

Upon stroking of junction 34, a primary leg 38 (see FIGS. 6 and 7) of junction 34 extends through an opening 40 in hanger 18. At a downhole end of primary leg 38 is a seal stack 42 to stab into a receptacle 44, as collet 30 engages a "no-go" profile 46 in sleeve 26. Also simultaneous to seals 42 stabbing into receptacle 44, seals 48 of lateral leg 28 stab into lateral receptacle 50 (see FIG. 1).

Focusing on junction 34, and as is ascertainable from the foregoing explanation; the junction comprises primary leg 38 and lateral leg 28. These are joined together at a more uphole portion of junction 34, identified as body 52. Body 52 is tubular in structure and houses the primary leg flow in an axial flow area of a sliding sleeve 54 as well as an annular flow comprising fluid from lateral bore leg 28. The annular flow is defined by the sliding sleeve 54 and the inside of body 52. If the sliding sleeve 54 is in an open position (choked or full open) then fluid from the lateral borehole 14 will flow into the sliding sleeve, and flow with the fluid from the primary borehole 12. Alternately, if the sliding sleeve is positioned to prevent flow (closed) then the fluid from lateral borehole 14 is prevented from moving uphole. It should be appreciated that it is also possible to flow only the lateral borehole 14 in this arrangement by opening the sliding sleeve 54 and running a plug downhole of the sliding sleeve 54 to shut off the primary bore.

Figure 5:
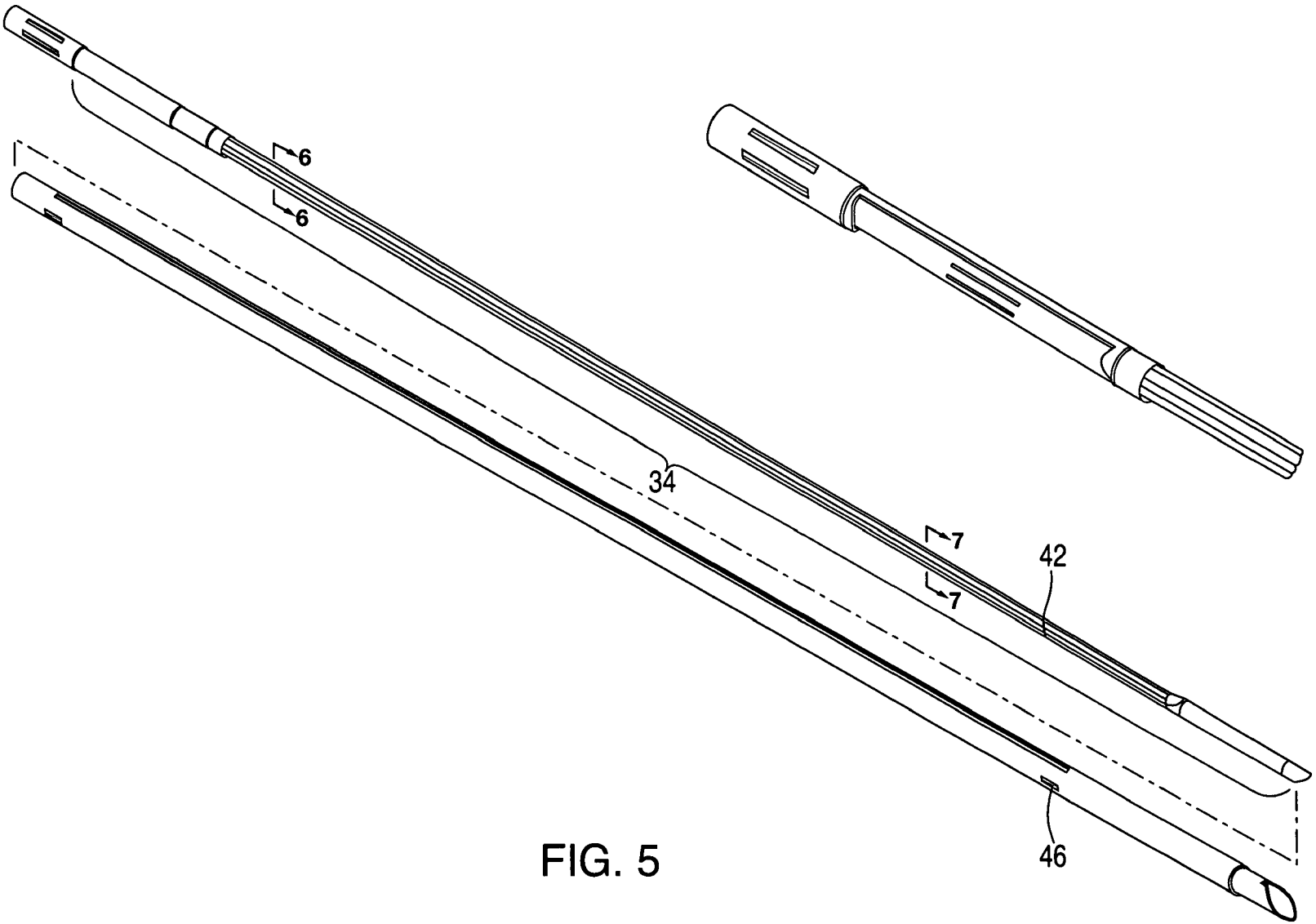
FIG. 5 is a schematic view of a junction and sleeve assembly in a partially exploded condition.
Figure 6:
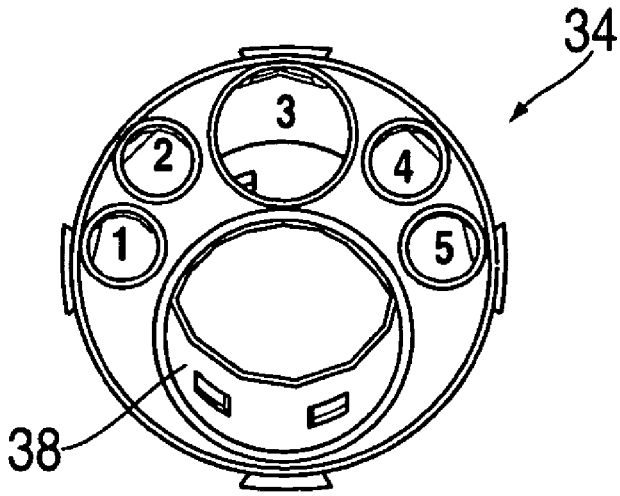
FIG. 6 is a cross-sectional view taken along section line 6-6 of FIG. 5.
Figure 7:
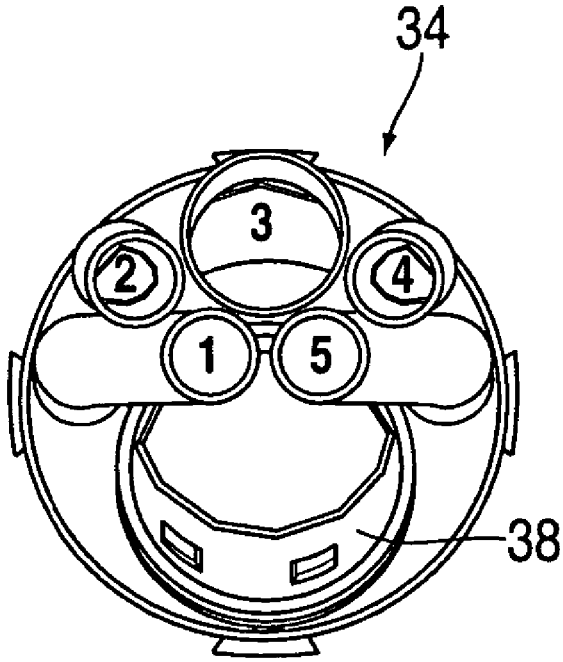
FIG. 7 is a cross-sectional view taken along section line 7-7 of FIG. 5.

One feature of the junction 34 directly addresses one of the short comings of the prior art in that a significant flow area is obtained for the junction 34 while maintaining cylindrical seal surfaces and cylindrical flow areas. This is accomplished in one embodiment as is illustrated in FIGS. 5, 6 and 7 by providing multiple tubulars that collectively makeup lateral leg 28. The individual tubulars are numbered 1-5 in FIGS. 6 and 7. One of skill should readily appreciate that the flow area is significant when summing each of the numbered areas. In the FIG. 6 location the tubulars are configured to run parallel to one another. In the FIG. 7 location however, the tubes 1-5 have been reconfigured to cause the collection of the tubes to begin to bend away from the main leg 38. More particularly, the lateral leg is biased into the lateral bore of the well by reconfiguring the five lateral tubes as shown in FIG. 7. The stiffness of tubes numbered one and five are used to bend leg number three away from primary leg 38 while number two and four remain straight. Such a configuration acts like a bent sub with respect to "desire" of the lateral leg (tubes 1-5) to move into the lateral bore. This is also to provide for a relatively circular pattern of the five tubes for entry to the manifold 58 described above.

Figure 8:
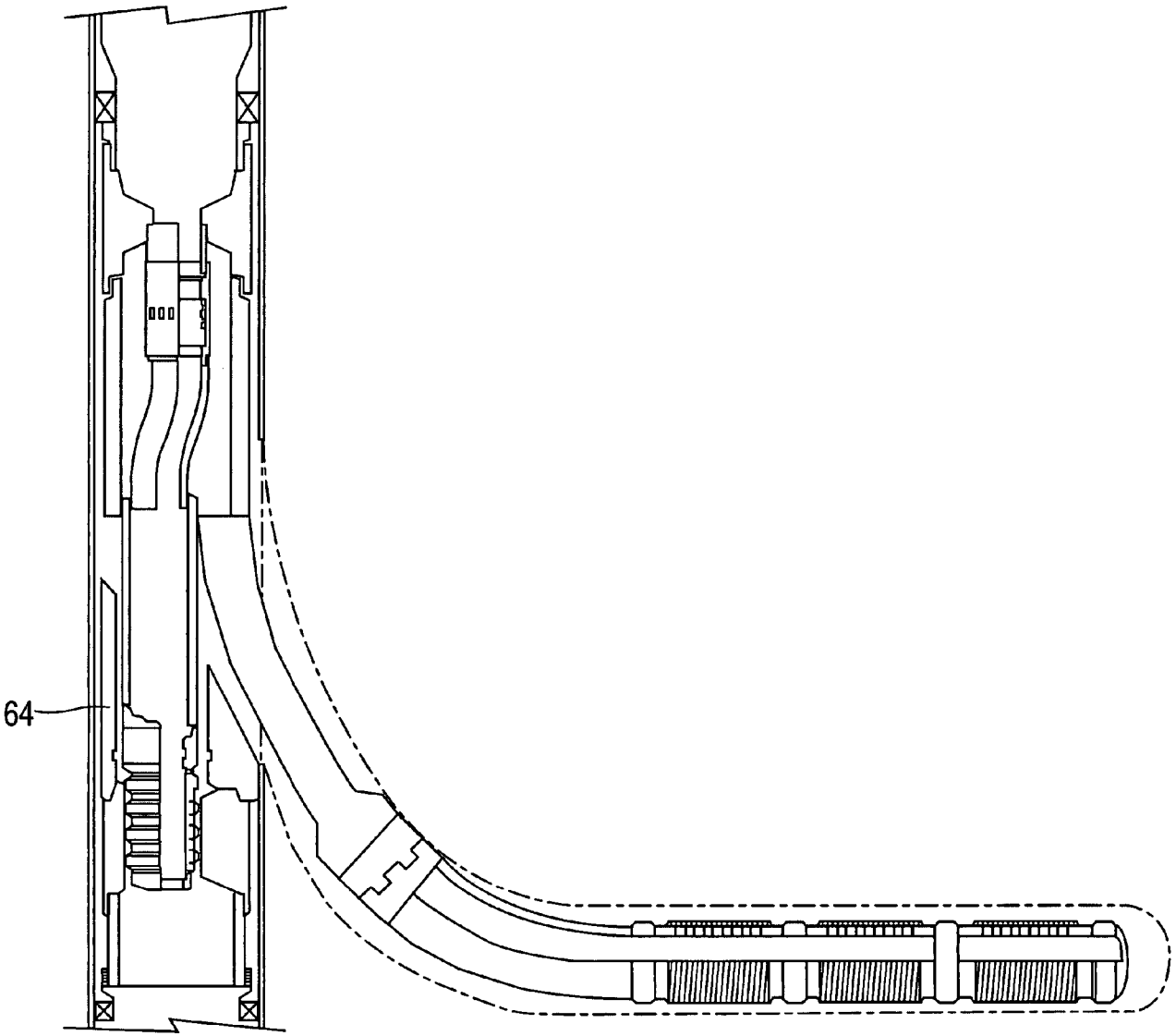
FIG. 8 is an alternate configuration employing the junction disclosed herein.

While the drawing FIGS. 6 and 7 are specifically related to a configuration of multiple tubulars making up the lateral leg, one of skill in the art will appreciate from this disclosure that the tubulars 1-5 could merely be passageways bored in a volume of material. The illustration of such will look identical to the FIG. 6 view. Because the individual passageways are spread relatively uniformly in the "material", that same material is relatively low in profile and therefore still achieves one of the goals of the invention by providing cylindrical flow areas while reducing the outside dimensions of the junction. In an alternate embodiment, referring to FIG. 8, the configuration is similar in representation to the figure one illustration but is illustrated even more schematically than is FIG. 1. The two embodiments each include junction 34 but this embodiment does not require sleeve 26 or offset sub 56 as a seal bore diverter 64 is used instead. Further, this embodiment has no need to stroke.

While preferred embodiments have been shown and described, modifications and substitutions may be made thereto without departing from the scope of the invention. Accordingly, it is to be understood that the present invention has been described by way of illustration and not limitation.

The invention claimed is:

1. A wellbore junction comprising:

a discrete primary leg; and a discrete lateral leg connected to the primary leg, the junction disposed at an intersection between a primary borehole and a lateral borehole, at least one of the legs comprising a plurality of non-nested tubular flow passageways defined by a plurality of tubulars at at least a portion of the at least one leg downhole of the intersection where the primary leg and the lateral leg are separate.

2. The wellbore junction as claimed in claim 1 wherein the plurality of non-nested tubular flow passageways define the discrete lateral leg.

3. The wellbore junction as claimed in claim 2 wherein the plurality of non-nested tubular flow passageways join to form fewer passageways remote from the junction.

4. The wellbore junction as claimed in claim 3 wherein the fewer passageways is one passageway.

5. The wellbore junction as claimed in claim 1 wherein the discrete lateral leg includes a bent joint to encourage entry to a lateral borehole.

6. The wellbore junction as claimed in claim 1 wherein the junction further comprises a flow control device disposed to convey flow fluid from the primary leg through an inside dimension thereof and to selectively regulate fluid flow from the lateral leg through ports in the device to the inside dimension of the device.

7. The wellbore junction as claimed in claim 1 wherein the at least one of the primary leg and the lateral leg comprise a seal.

8. The wellbore junction as claimed in claim 7 wherein both the primary leg and lateral leg include seals to sealingly engage a primary borehole downhole of the junction and a lateral borehole downhole of the junction.

9. The wellbore junction as claimed in claim 1 wherein the junction further includes an external orientation sleeve.

10. The wellbore junction as claimed in claim 9 wherein the external orientation sleeve includes an orientation profile at a downhole end thereof.

11. The wellbore junction as claimed in claim 9 wherein the external orientation sleeve includes an alignment slot.

12. The wellbore junction as claimed in claim 1 wherein the plurality of non-nested tubular flow passageways comprise five individual tubular structures arranged semi-circularly in cross-section.

13. The wellbore junction as claimed in claim 12 wherein a center tubular of the five tubular structures is of larger cross-sectional area than the other four structures.

14. The wellbore junction as claimed in claim 12 wherein the outermost tubular structure on each side of the semicircular array of five tubular structures are angled inwardly and into urging contact with the center tubular structure to urge the center tubular structure.

15. The wellbore junction as claimed in claim 1 wherein the system further comprises:

a hook hanger liner hanger having an orientation profile hereof; and a second orientation profile at the junction, complementary to the hook hanger orientation profile.

16. A wellbore system comprising:

a junction having a discrete primary leg; and a discrete lateral leg connected to the primary leg, at least one of the legs comprising a plurality of non-nested tubular flow passageways defined by a plurality of tubulars, the junction disposed at an intersection between a primary borehole and a lateral borehole, at least a portion of the non-nested tubular flow passageways being in a portion of the at least one leg at a location of the borehole downhole of the intersection where the lateral leg and the primary leg are separate.

17. A method for installing a junction in a wellbore comprising:

running a junction having a discrete primary leg, and a discrete lateral leg connected to the primary leg at least one of the legs comprising a plurality of non-nested tubular flow passageways defined by a plurality of tubulars;

landing the junction at an intersection between a primary borehole and a lateral borehole; and causing the lateral leg to enter the lateral borehole such that at least portions of the non-nested tubular flow passageways extend beyond the intersection.

18. The method for installing a junction in a wellbore as claimed in claim 17 wherein causing the lateral leg to enter the lateral borehole is by orienting the junction and allowing a bent sub at the lateral leg to find the lateral borehole.

19. The method for installing a junction in a wellbore as claimed in claim 18 wherein the landing includes orienting of the junction on an orientation profile of a previously installed hook hanger liner hanger.

20. The method for installing a junction in a wellbore as claimed in claim 18 wherein the causing the lateral leg to enter the lateral borehole is by configuring the plurality of non-nested tubular flow passageways to urge a center passageway of the plurality of non-nested tubular flow passageways in a direction away from a centerline of the junction.

* * * * *